US007040226B2

(12) United States Patent
Rauh

(10) Patent No.: US 7,040,226 B2
(45) Date of Patent: May 9, 2006

(54) PRINTING UNIT

(75) Inventor: Volker Gerold Rauh, Hettstadt (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 84 days.

(21) Appl. No.: 10/480,792

(22) PCT Filed: Jan. 17, 2002

(86) PCT No.: PCT/DE02/00121

§ 371 (c)(1),
(2), (4) Date: Dec. 19, 2003

(87) PCT Pub. No.: WO03/000496

PCT Pub. Date: Jan. 3, 2003

(65) Prior Publication Data

US 2004/0237817 A1 Dec. 2, 2004

(30) Foreign Application Priority Data

Jun. 20, 2001 (DE) ..... 101 29 762

(51) Int. Cl.
*B41F 7/02* (2006.01)
*B41F 5/00* (2006.01)

(52) U.S. Cl. ..... 101/218; 101/216; 101/248; 101/479

(58) Field of Classification Search ..... 101/218, 101/216, 248, 479

See application file for complete search history.

(56) References Cited

U.S. PATENT DOCUMENTS

| | | | | |
|---|---|---|---|---|
| 3,527,165 | A | 9/1970 | Harless | |
| 4,442,773 | A * | 4/1984 | Kobayashi | 101/177 |
| 5,265,529 | A | 11/1993 | Tafel | |
| 5,445,076 | A | 8/1995 | Sugiyama et al. | |
| 5,697,296 | A * | 12/1997 | Thunker et al. | 101/216 |
| 6,019,039 | A | 2/2000 | Knauer et al. | |
| 6,216,592 | B1 * | 4/2001 | Knauer et al. | 101/247 |
| 6,408,748 | B1 | 6/2002 | Hajek et al. | |
| 6,502,509 | B1 * | 1/2003 | Gottling et al. | 101/248 |
| 2001/0003954 | A1 * | 6/2001 | Leib et al. | 101/145 |
| 2003/0075060 | A1 * | 4/2003 | Plewa | 101/216 |
| 2003/0188661 | A1 * | 10/2003 | Fischer | 101/485 |

(Continued)

FOREIGN PATENT DOCUMENTS

DE 40 34 323 A1 4/1992

(Continued)

*Primary Examiner*—Ren Yan
*Assistant Examiner*—Marvin P. Crenshaw
(74) *Attorney, Agent, or Firm*—Jones Tullar & Cooper PC

(57) ABSTRACT

A printing unit contains at least one printing group which is comprised of at least two cylinders which cooperate to form a printing nip. At least these two cylinders are interconnected in a positive fit by a drive. The two cylinders can be engaged with one another in a first position (ON), or disengaged from one another in a second position (OFF). The two cylinders can also be disengaged from each other at a spacing distance in a third position (STOP). That spacing distance is sufficient to allow a web in the printing operation to be guided between the two cylinders without making contact with the two cylinders.

43 Claims, 4 Drawing Sheets

U.S. PATENT DOCUMENTS

| | | | | |
|---|---|---|---|---|
| 2004/0123756 | A1* | 7/2004 | Patzelt | 101/218 |
| 2004/0177778 | A1* | 9/2004 | Christel et al. | 101/216 |

FOREIGN PATENT DOCUMENTS

| | | | |
|---|---|---|---|
| DE | 93 11 113.4 | U1 | 10/1993 |
| DE | 44 01 289 | A1 | 7/1995 |
| DE | 44 30 693 | A1 | 3/1996 |
| DE | 196 03 663 | A1 | 8/1997 |
| DE | 198 53 114 | A1 | 5/2000 |
| EP | 0 862 999 | A2 | 9/1998 |
| GB | 2 309 668 | A | 8/1997 |

* cited by examiner

PRINTING UNIT

FIELD OF THE INVENTION

The present invention is directed to a printing unit with at least one printing group. The printing group includes at least two cylinders which are shiftable, with respect to each other, between three positions.

BACKGROUND OF THE INVENTION

A printing unit is known from DE 44 30 693 A1. A double printing group, consisting of two transfer cylinders forming a print position and the associated forme cylinders, can be driven by a common drive motor. A transfer cylinder can be brought into two positions, a print-on and a print-off position, by the provision of eccentric seating.

EP 0 862 999 A2 discloses a double printing group in which the two transfer cylinders, which together form a print position, are not in a driven connection with each other. Instead, each has a drive motor together with the associated forme cylinder. In addition to on and off positions, the two transfer cylinders can be brought into a third position in relation to each other, in which third position, a web can be passed between the two transfer cylinders during the printing operation.

A device for putting cylinders into contact is known from DE 44 01 289 A1. Besides an out of contact position of the cylinders, it is possible with this device to set two different contact positions of the cylinders in relation to each other for different thicknesses of the web of material. In this case, a support element having two different stops is provided for the setting.

DE 93 11 113 U1 shows a double printing group through which a web of printed material can be guided, in a contactless manner, in a print-off position. The contactless passage is achieved by the use of guide rollers which are arranged upstream and downstream of the print position.

In DE 198 03 663 A1 the intention is to maintain, if possible, a print position during a flying plate change. This is achieved, inter alia, by use of a forme cylinder which can be driven independently of the associated transfer cylinder. During the plate change, the transfer cylinder continues to work as a counter-pressure cylinder, together with the web, and is in a driven connection with the counter-pressure cylinder.

U.S. Pat. No. 5,265,529 discloses cylinders which can be brought into three different positions. The various end positions can be adjusted, with respect to the contact position, in accordance with defined paper thicknesses etc. by the use of adjusting devices. Stops limit the contact path toward the others cylinders.

A drive mechanism for a printing unit is known from DE 198 53 114 A1. By the introduction of intermediate gear wheels into a drive train, the gear wheel engagement in the drive mechanism is independent, to a large extent, of the position of the cooperating cylinders.

SUMMARY OF THE INVENTION

The object of the present invention is directed to providing a printing unit.

In accordance with the present invention, this object is attained by providing a printing unit with at least one printing group. That at least one printing group can include a transfer cylinder which is drivable by a drive motor and which can be selectively positioned in one of three positions.

A shiftable stop can be used to define at least two of these positions. The printing group may include two cylinders which act together to form a gap or nip. These two cylinders can be driven by a common drive motor. The two cylinders can be in contact with each other in a first position and can be moved apart to either of two separated positions as a function of the operating situation of the drive mechanism for the printing group.

The advantages to be gained by the present invention primarily lie in that by use of three positions, a "regular" removal of one cylinder from contact with another cylinder is made possible, for example in case of a change in the production, during stops, etc. is made possible. Also the removal out of contact of the cylinders to a distance which, for example, permits the contactless passage of the web, which, for example, is part of a printing operation, through the printing gap can be accomplished.

Bringing the cylinders out of contact, to a relatively large spacing distance, permits the contactless passage of a web, without additional guide rollers, which prevent the "fluttering" or oscillation of the web. The additional guide rollers might also possibly result in reducing the quality of fresh prints.

If the cylinders of a printing group can be driven together by a driven connection, which driven connection is maintained in every one of the cylinder positions, the release of a web during the printing operation is possible with a reduced number of drive motors.

The possibility of removing an entire printing group from the printing process is advantageous wherein, however, the web continues to run between the transfer cylinders. Because of the continuing engagement of the positive driven connections, the relative position of the cylinders, in respect to each other, is maintained on the one hand. On the other hand, a set-up operation, by use of a single drive motor, is made possible in the case of one drive motor per printing group with steel cylinders, or a double printing group and, by use of only one auxiliary motor in the case of one drive motor for two double printing groups, for example printing tower, H-printing unit, or two bridge printing units.

If two printing groups, each with its own drive motor, are provided, two printing groups, which are arranged one behind the other in the conveying direction, allow two-color printing (1/1+1/1=2/2), or single printing on both sides with the first (1/1+0/0) or the second (0/0+1/1) printing group in alternation. Thus, with an appropriate configuration of a gear wheel engagement, in regard to the position of the cylinders, in which the web is freely guided through the printing gap, a set-up operation is possible in alternation between the first and the second printing group, for example during operation with a flying plate change.

The regulation of the drive mechanism of the printing group and of a stop for blocking a release under defined operating conditions, or for the prevention of the cylinders making contact under certain operating conditions, permit the release, along with assured high safety of the gears of the driven connection and of an operator, as well as interference-free continued printing.

Three possible defined positions for the transfer cylinder exist. The center position, or the respective stop position, is selectively taken up, or becomes effective, as a function of the driving situation such as, for example, the number of revolutions, or the cylinder coupling state.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENT

Figure 1:
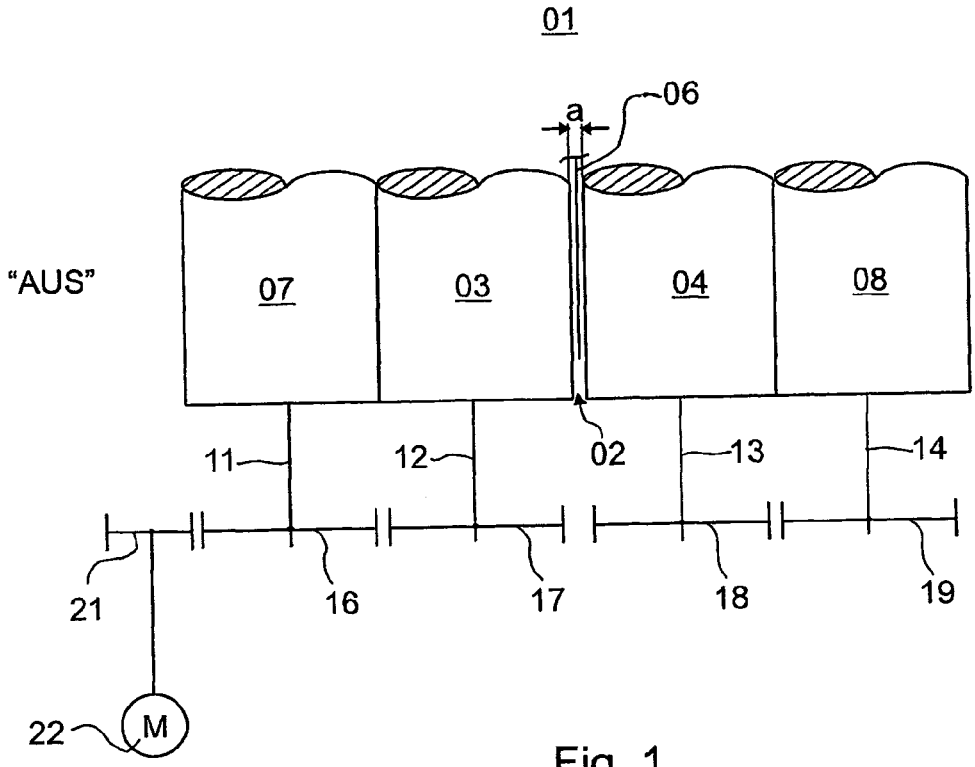
FIG. 1, a schematic top plan view of a printing group in accordance with the present invention, in FIG. 2, a schematic side elevation view of a driven connection of a printing group, in FIG. 3, a schematic side elevation view of a mechanism for pivoting a cylinder, in FIG. 4, a schematic side elevation view of a printing unit with two printing groups, and in FIG. 5, a schematic side elevation view of a driven connection of the printing unit in accordance with FIG. 4.

A printing unit of a printing press, in particular a printing unit of a web-fed rotary printing press, has a printing gap 02, in which a web 06, for example a paper web 06, can be guided, all as may be seen in FIG. 1.

In the preferred embodiment depicted in FIG. 1, the two cylinders 03, 04 forming the printing gap 02 are embodied as transfer cylinders 03, 04, and in particular as rubber blanket cylinders 03, 04, to each of which a further cylinder 07, 08, for example a forme cylinder 07, 08, is assigned. Inking or dampening systems, which are not specifically represented, are also provided. One of the two cylinders 03, 04 forming the printing gap 02 can alternatively be embodied as a counter-pressure cylinder 04, 03, for example as a satellite or steel cylinder, which cylinder 04 does not carry any ink.

The ends of the four cylinders 03, 04, 07, 08 of the printing group 01, which is embodied as a double printing group 01, are each rotatably seated in a frame of the printing press, which frame is not represented. In this case, at least one of the two transfer cylinders 03, 04, for example the transfer cylinder 03, has a bearing 09, depicted in FIG. 3 which permits a relative position change of the two transfer cylinders 03, 04 with respect to each other, in particular a change Δ "a" of a distance "a" between the two transfer cylinders, as seen in FIG. 1. In the preferred embodiment represented in FIG. 3, bearings 10 for the remaining cylinders 04, 07, 08 are not further discussed and are each provided with the reference numeral 10.

Figure 3:
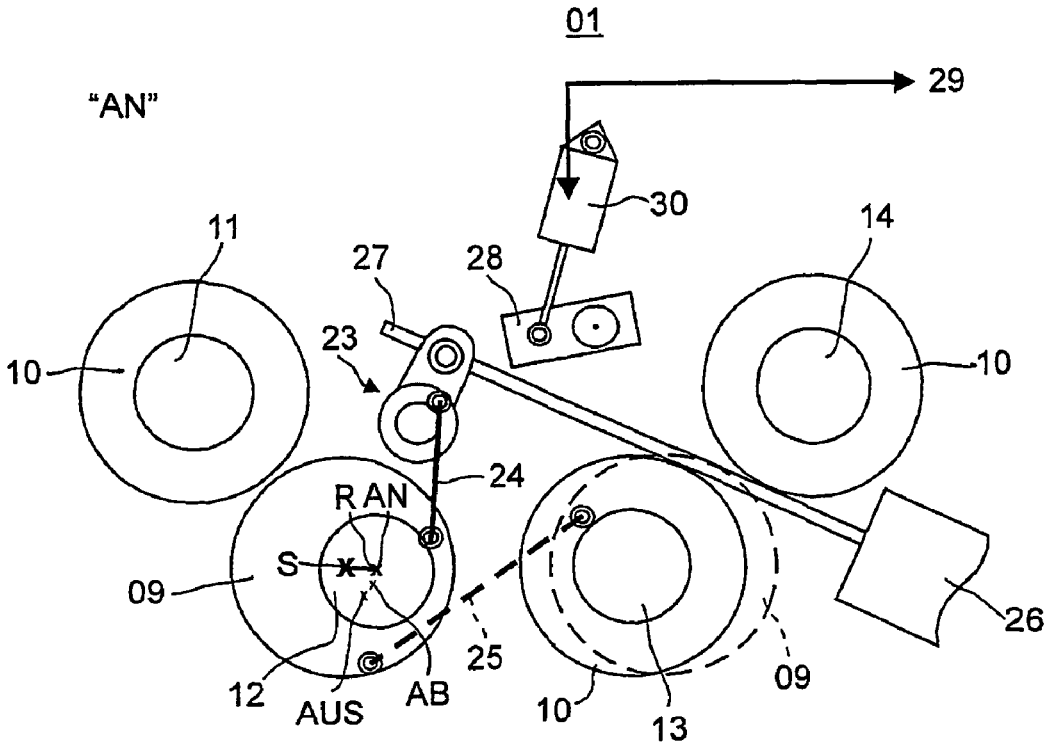

In a variation of the subject invention, as represented in dashed lines in FIG. 3, the second transfer cylinder 04 also has a bearing 09, which is represented in dashed lines, and which also allows a position change. In this case, the two bearings 09 are coupled with each other in a manner, which is not specifically shown, in such a way that, when actuated, they perform a synchronous movement, however in opposite directions.

The transfer cylinders 03, 04 can be brought into at least three different positions, i.e. spacings a1, a2, a3, in relation to each other, wherein the transfer cylinders 03, 04, in a first position AN or "in contact," are placed against each other with a first spacing a1=0. In a second position AB or "out of contact," cylinders 03, 04 are spaced apart from each other at a second spacing a2 wherein a3>a2>0. In a third position AUS, or "removed from each other", the cylinders 03, 04 are spaced apart from each other at a third spacing a3 at a sufficient distance that, during the printing operation, the paper web 06 can be guided through the printing gap 02, for example without touching the transfer cylinders 03, 04, which may now run slower or which may be stopped for the purpose of a set-up. Stopping of the paper web 06, or drawing it in to the printing group 01 is also possible, while independently thereof, the cylinders 03, 04, 07, 08 are accessible for a set-up operation such as, for example washing, pre-inking, printing forme change, rubber blanket change, putting images on the forme cylinder 07, 08 or the like. In the second, out of contact position AB, the two transfer cylinders 03, 04 are out of contact with each other, but the drawn-in web 06 can be maintained in contact with one of the adjustable cylinders 03, 04 in order to, for example, maintain web guidance. Moreover, moving the cylinders 03, 04 to the first, contacting position AN requires a considerably shorter actuating path than would be required if the cylinders 03, 04 were in the third, removed from each other position AUS.

In the preferred embodiment, the four cylinders 03, 04, 07, 08 are in a positive driven connection with each other by use of driven gear wheels 16, 17, 18, 19, which are arranged on journals 11, 12, 13, 14 at the cylinder end faces, as seen in FIG. 1. The geometry of the gear wheels 16, 17, 18, 19, as well as of the bearing(s) 09 is selected in such a way that the driven connection is maintained in every one of the three positions AN, AB, AUS of the two cylinders 03, 04. The cylinders 03, 04, 07, 08, which are in driven connection, are driven via a drive gear 21, for example a drive gear wheel 21 or a drive pinion 21 of a drive motor 22, which drive gear 21 meshes with one of the gear wheels 16, 17, 18, 19 of the cylinders 03, 04, 07, 08 In the configuration shown in FIG. 1, the drive gear 21 meshes with the driven gear wheel 16 of the forme cylinder 07. However, driving one of the cylinders 03, 04, 07, 08, or one of the journals 11, 12, 13, 14, by use of the drive motor 22, can also take place directly and coaxially.

In the preferred embodiment, the three positions AN, AB, AUS are made possible by utilization of the bearing 09, which bearing 09 is configured as an eccentric bearing 09 for the transfer cylinder 03, for example as a three-ring or as a four-ring bearing, preferably as a three-ring bearing because of the reduced cost outlay. This position change of the cylinder 03 takes place by pivoting an axis of rotation R of the transfer cylinder 03 around a pivot axis S of the bearing 09. The possibly additional eccentric bearing 09 for the second transfer cylinder 04 is shown in dashed lines. Further possible eccentric bearings for the forme cylinders 07, 08, for example to accomplish additional movements of those cylinders in or out of contact, are not taken into consideration in the drawings. The journals 11, 13, 14 of the remaining cylinders 04, 07, 08 are represented by solid lines in FIG. 3, and are centered by way of example.

If one of the two cylinders 03, 04 forming the printing gap 02 is not conveying ink, either the transfer cylinder 03, 04, or the other cylinder 04, 03, or both, can be seated by the use of an eccentric bearing 09.

Figure 2:
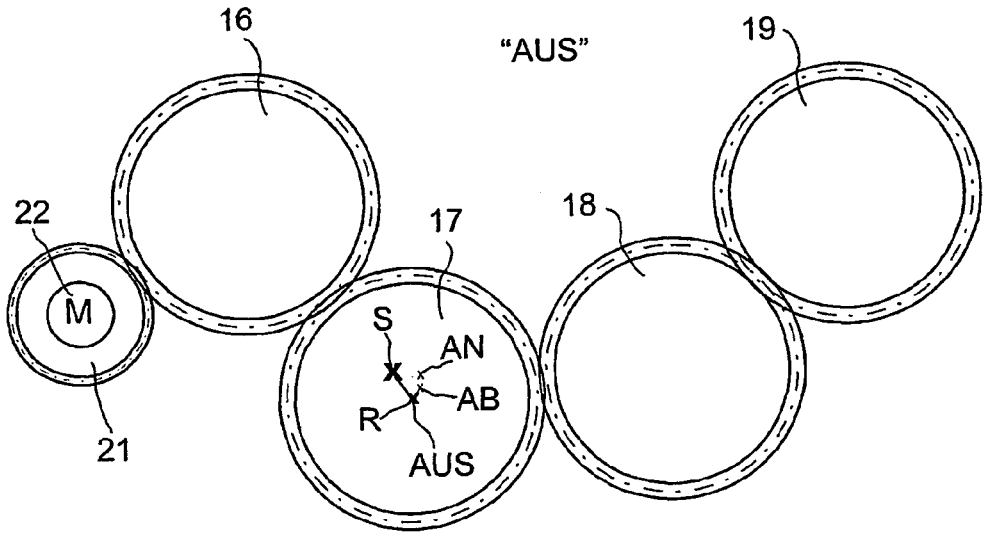

In FIG. 1, the two transfer cylinders 03, 04 are removed from each other in the third position AUS at a distance a=a3, for example in which 5 mm≦a3≦10 mm, in particular a3≈8 mm in such a way that the paper web 06 can pass through the printing gap 02 without contact. In accordance with the representation in FIG. 2, the gear wheels 17, 18 of the transfer cylinders 03, 04 are just in engagement with each other, something that could not be seen in the schematic representation in FIG. 1. An axis of rotation R of the transfer cylinder 03, or of its pinion gear 17, can be selectively brought into each one of the three positions AN, AB, AUS, which are identified by the crosses in FIG. 2, by pivoting the eccentric bearing 09 around a pivot axis S.

By way of example, FIG. 3 represents the drive mechanism for the position change of an arrangement in accordance with the above mentioned principle. FIG. 3 shows the journal 12 of the transfer cylinder 03 in the first position AN, in which first position AN, the transfer cylinders 03, 04, which cannot be seen in FIG. 3, have been placed into contact with each other. The eccentric bearing 09 can be pivoted, for example, by operation of pivoting a lever 23 via a coupler 24 inside a bushing, not represented, of circular cross section. For example, pivoting the lever 23 in a clockwise direction causes the pivoting of the eccentric bearing 09 also in a clockwise direction, and therefore causes a movement of the journal 12 away from the bearing of the second transfer cylinder 04, i.e. a change of the cylinders 03, 04 into the second position AB or, with further pivoting, into the third position AUS. In case of an eccentric seating of the second transfer cylinder 04, the latter can be moved synchronously with cylinder 03 and in the opposite direction with respect to cylinder 03 by the use of a second coupler 25, which second coupler 25 is indicated by dashed lines in FIG. 3.

The driving of the coupler 24 is provided by the use of a one-armed lever 23, whose free end is in operative connection with a threaded spindle 27, which spindle 27 can be rotated by a motor 26. A rotation of the threaded spindle 27 in one or the other direction causes the pivoting of the lever 23, and therefore causes the pivoting of the eccentric bearing 09 in the one or in the other direction. However, the driving of the eccentric bearing 09 could also take place via a cylinder, which cylinder can be charged with a pressure medium, or also by a drive mechanism that is directly working together with the bearing 09.

If the transfer cylinder 03, or the transfer cylinders 03, 04, is or are in its or their first position AN, pivoting of the transfer cylinder 03 into the second position AB is possible by an appropriate pivoting of the lever 23. However, pivoting of the transfer cylinder 03 into the third position AUS has been structured so that this pivoting movement can be blocked. The out-of-contact path of the cylinders 03, 04, or the distance "a" between the cylinders 03, 04, can be selectively limited to the position AB, or can be expanded as far as into the position AUS, by the provision of a stop 28, whose position can be changed, or which can be pivoted.

In the preferred embodiment, to accomplish this result, the stop 28, for example which may be a free end of a second one-armed lever, can be positioned into the movement radius of the free end of the lever 23 by an actuating device 30, for example by use of a cylinder 30 which can be charged with a pressure medium. During "normal" printing operations, i.e. during the change between the first two positions AN, AB, this lever 28 also advantageously acts as a stop for the defined out of contact position AB. The use of this lever 28 as a stop is particularly advantageous in the case in which the first lever 23 is driven by a mechanism, such as a cylinder which can be charged with a pressure medium, since positioning of the first lever 23 in an "intermediate position" by using pressure alone, for example, is practically not possible.

Figure 5:
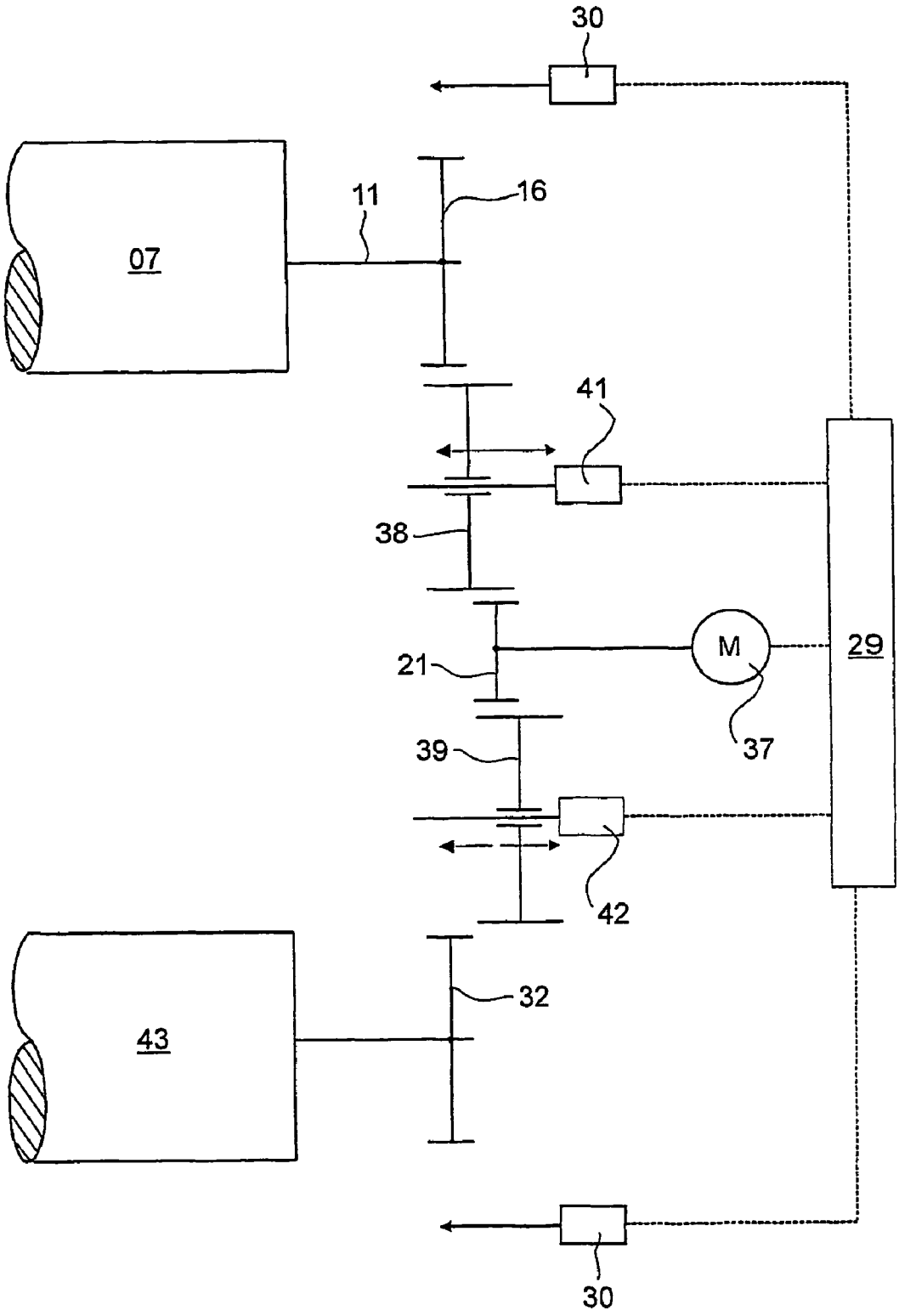

The actuating device 30 for the stop 28 can be controlled by a control device 29, which is shown only in FIG. 5 in such a way that a change of cylinder 03 from the first or the second position AN, AB into the third position AUS is prevented by the stop 28 at least in the case in which the printing group 01, or the transfer cylinders 03, 04 are operated above a defined threshold number of revolutions, or at the production number of revolutions. The stop 28 is only released into the position AUS when the printing group 01 has been stopped, or is operated at a number of revolutions below a threshold number of revolutions, or is in a set-up operation, i.e. a number of revolutions asynchronous in relation to the production number of revolutions.

In an advantageous embodiment, at least the third position AUS can be detected by a signal emitter, which is not specifically represented, for example by a limit switch, wherein the signal is also supplied to the control device 29.

If the printing group 01 can be driven by its own drive motor 22 independently of a further printing group, the angular speed, or the number of revolutions of the drive motor 22, or of one of the cylinders 03, 04, 07, 08, or the circumferential speed at the transfer cylinder 03, for example, are determined and supplied to the control device 29, in which a comparison with the existing operational state is performed. If, for example, the condition exists, in which the printing group 01 is being operated in readiness for production, or is operating above a threshold value, the stop 28 is placed into its effective position, in which effective position of stop 28 a position change of the cylinder 03 or cylinder 04 into the third position AUS is blocked.

It is also advantageous for the protection of the drive connection and the press operators if the printing group 01 can be operated with cylinders in the position AUS only in defined modes of operation, for example only during set-up operations, i.e. when the cylinders are driven at a limited number of revolutions. A maximum number of revolutions can also be preset for this, for example, which maximum number of revolutions can correspond to the threshold number of revolutions for the change from the position AB into the position AUS. This can be preset by use of the control device 29 for controlling the drive motor 22. In this case, an acceleration, independently of the running of the paper web 06, to a number of revolutions which is synchronous with the printing operation can only take place in a position which is located between the positions AUS and AN and is limited in the direction AUS by the stop 28, for example in the position AN. The limitation is preferably provided via the electronic elements, i.e. for example via the control device 29.

The control device 29 also prevents a change of the cylinder 03 or cylinders 03, 04 from the position AUS, or from the position AB, into the position AN if, in the course of the operation of the printing press, i.e. when the paper web 06 passes through the printing gap 02, the printing group 01 does not run at a number of revolutions which is synchronous with the running speed of the paper web 06, or if the printing group 01 is not in a driven connection with the drive motor 22.

The above-described device, as well as the above-described operational situations, also apply to printing groups 01 whose cylinders 03, 04 forming the print position 02, one of which is possibly also embodied as a satellite cylinder form a driven connection which is independent of the drive mechanism of the forme cylinders 07, 08 and which is driven by its own drive motor. Thus, for example, in a rubber-against-rubber printing group, the two transfer cylinders 03, 04 can be driven by one drive motor, and the two forme cylinders 07, 08 can be driven by one by or two further drive motors which are suitable for the production operation.

This also applies if one or if several transfer cylinders 03, 04 are driven together with a satellite cylinder, and the associated forme cylinders 07, 08 are driven separately.

Figure 4:
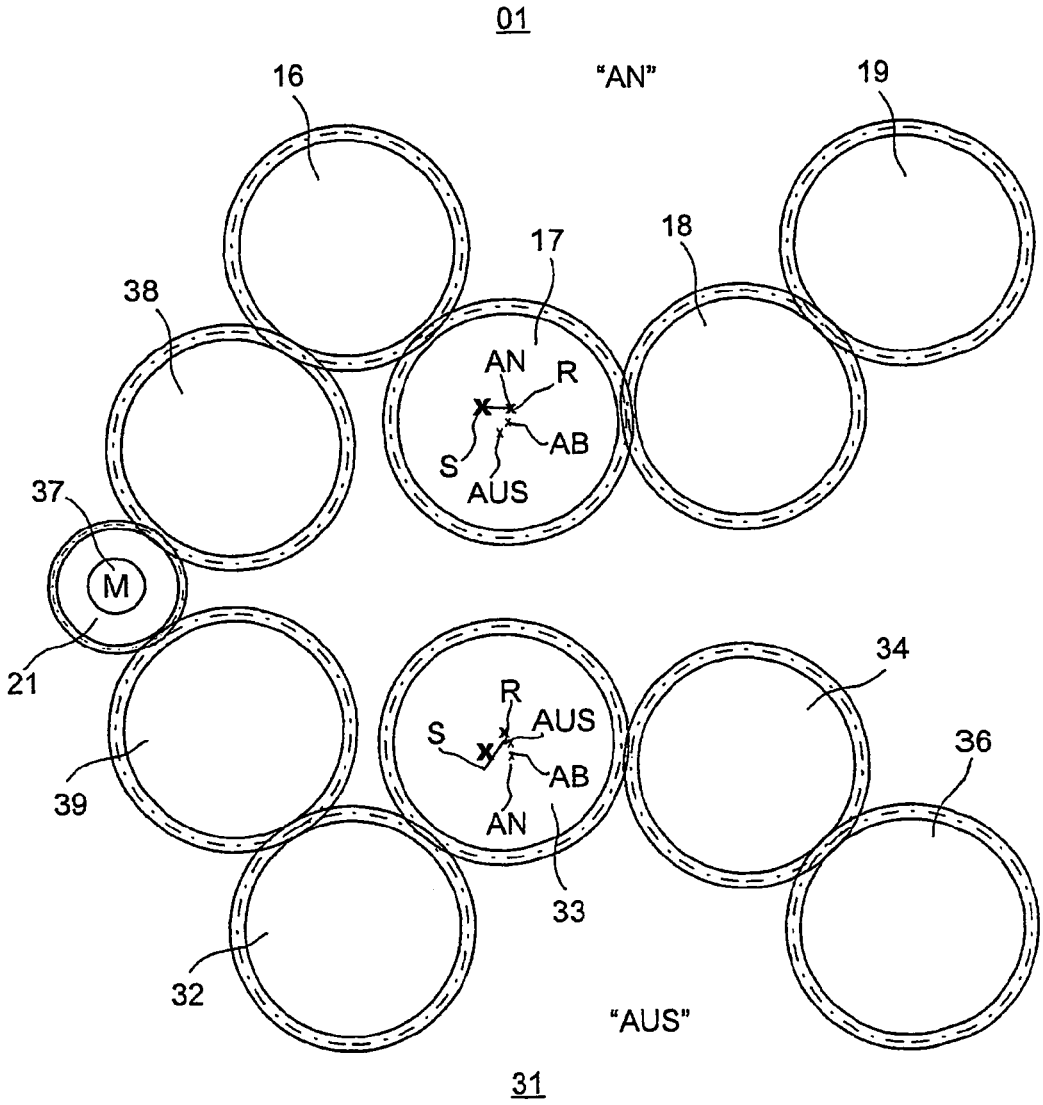

In a further preferred embodiment of the present invention, the printing group 01 can also be driven together with a second printing group 31, as seen in FIG. 4, which second printing group 31 has gear wheels 32, 33, 34, 36 of two further transfer cylinders and two further forme cylinders by a common drive motor 37, with only the gear wheels 32, 33, 34, 36 of cylinders of the second printing group 31 being represented in FIG. 4. In this case, it is advantageous, if driving takes place from the drive motor 37 via one gear wheel 38, or 39 in the direction toward the printing groups 01, or 31, respectively. At least one of the gear wheels 38, 39 is embodied so that by use of a coupling 41, 42, as seen FIG. 5 it can be selectively connected with, or disconnected from, the gear wheel 16 of the first printing group 01, or the gear wheel 42 of a forme cylinder 43 of the second printing group 31. This can, for example, be accomplished by the use of gear wheels 38, 39 which are displaceable in the axial direction.

The information regarding an open coupling state of each of the coupling 41, 42 is sent to the control device 29, for example via limit switches, which are not specifically represented, whereupon the pivoting of the associated transfer cylinder into the position AN is prevented by the control device 29. If the printing group 01, 31 runs synchronously with the production and/or the engaged coupling 41, 42, the change into the position AUS is blocked via the actuating device 30 and the stop 28, as seen in FIG. 3. For controlling the actuating device 30, it is also possible to utilize the number of revolutions of the printing group 01, 31, or of the transfer cylinder 03, and to process it in the control device 29.

FIG. 4 and FIG. 5 show a printing unit embodied in the form of an H-printing unit, wherein the lower printing group 31 is disengaged and a pivotable transfer cylinder, that is associated with the gear wheel 33, is in the third position AUS. The upper printing group 01 is engaged and the transfer cylinder 03 is in the first, in contact position AN.

In a preferred embodiment, which is not depicted , one of the two gear wheels 38, 39 can also be embodied as a double gear wheel 38, 39, which cannot be coupled, wherein one half of the double gear wheel meshes with the gear wheel 16, 32 of the forme cylinder 07, 43, and the other half meshes with the gear wheel 21 of the drive motor 37. In an advantageous embodiment, the halves can be embodied to be displaceable in relation to each other for registration, for example between the two printing groups 01, 31, or between further units of the printing press.

In all cases in which two printing groups 01, 31 can be driven by a common drive motor 37, it is advantageous, for the purpose of set-up operations, to provide an auxiliary drive mechanism, which is not specifically represented, in the drive connection of a printing group 01, 31 which auxiliary drive mechanism can be disengaged.

The mode of functioning of the printing unit in accordance with the present invention is as follows:

As is the case with customary double printing groups, the printing groups 01, 31 of the printing unit can each be operated during "normal" printing operations selectively in a position AN and AB. It is also additionally possible to guide the paper web 06 during the printing operation through the printing group 01, or 31 while this printing group 01, 31 is not participating in the printing operation, i.e. is inactive. To this end, the printing group 01, or 31, or its transfer cylinders 03, 04, are pivoted into the position AUS. As long as the printing group 01, 31 is operated at a number of revolutions above a threshold number of revolutions, and/or a coupling 41, 42 possibly located between the drive motor 37 and the printing group 01, 31 is closed, the change into the third position AUS is blocked.

If the drive mechanism of the printing group 01, or 31 is no longer operated synchronously with the running of the paper web 06, or is operating at a number of revolutions below the threshold number of revolutions, pivoting of the transfer cylinders 03, 04 into the position AUS is released by the control device 29 in that the stop 28 is brought into an ineffective position. This can take place either when the drive motor 22 driving the printing group 01, or the printing group 31, are no longer driven synchronously with the paper web 06, but instead are in a set-up operation, or are stopped. If the printing group 01, 31 is driven by a common drive motor 37 via a switchable coupling 41, 42, the release takes place, for example, on the basis of the open coupling state of the coupling 41, 42.

For the purpose of accelerating the printing speed, or the printing number of revolutions, the printing group 01, 31 must initially be brought out of the position AUS into an intermediate position, for example into the position AB. The printing group 01, 31 can then be returned into the position AN only when the circumferential speed, or the corresponding number of revolutions, corresponds to that of the paper web 06.

In the case of the embodiment of the printing unit with two printing groups 01, 31, a 2/2 printing operation, and also an alternating 1/1 printing operation, for the purpose of a flying plate change, can take place by use of the printing unit. To this end, one of the printing groups 01, 31 is placed into the position AN, while the other printing group 31, 01 is placed into the position AUS. Now a set-up operation, for example a plate change, is possible in connection with the printing group placed in the position AUS.

In an advantageous embodiment, the printing group 31, 01 must now first be brought into the intermediate position again, for example into the second, out of contact position AB, before the printing group 31, 01 can again be accelerated. If the number of revolutions of the printing group 31, 01 has again been synchronized with the running of the web, i.e. has been accelerated again and engaged, if required, the blockage for movement into the first, in contact position AN is removed, and the printing group 31, 01 can again be brought into the position AN. It is now possible, for example, to bring the first printing unit 01, 31 into the third, removed from each other, position AUS for set-up as soon as the number of revolutions drops below the threshold number of revolutions, or the respective coupling 42, 41 is released.

While preferred embodiments of a printing unit, in accordance with the present invention, have been set forth fully and completely hereinabove, it will be apparent to one of skill in the art that various changes in, for example, the type of web being printed, the overall structure of the printing press and the like could be made without departing from the true spirit and scope of the present invention which is accordingly to be limited only by the appended claims.

The invention claimed is:

1. A printing unit comprising:

at least a first printing group, said at least first printing group including a transfer cylinder;

a second cylinder, said second cylinder cooperating with said transfer cylinder and defining a printing gap adapted to receive a web guided through said printing gap;

a drive motor adapted to drive said transfer cylinder;

means supporting at least one of said transfer cylinder and said second cylinder for movement between first, second, and third different positions, said first, second and third positions defining a disengagement path for one of said transfer cylinder and said second cylinder;

a distance of said disengagement path increasing from said first position to said third position and being limited between said first and second positions in a direction toward a greater distance as a function of an operating parameter of a drive mechanism of the printing group; and stop selectively preventing movement of at least one of said transfer cylinder and said second cylinder to said third position, wherein in said first position, said transfer cylinder and said second cylinder are in contact, wherein in said second position, said transfer cylinder and said second cylinder are out of contact with each other, and wherein in said third position, said transfer cylinder and said second cylinder are out of contact and are spaced further apart than they are in the 2nd position whereby a web can be guided between them, without contact, during a printing operation.

2. The printing unit of claim 1 wherein said transfer cylinder and said second cylinder are in positive driven connection with each other and can be driven by said drive motor.

3. The printing unit of claim 2 wherein said positive drive connection is maintained in each of said first, second and third positions.

4. The printing unit of claim 1 further including a second printing group arranged after, in a direction of web travel, said at least first printing group.

5. The printing unit of claim 4 including a separate drive for each of said first and second printing groups.

6. The printing unit of claim 4 wherein said first and second printing groups are in positive drive connection, and further including a common drive motor for said first and second printing groups.

7. The printing group of claim 6 further including at least one switchable coupling between at least one of said first and second printing groups and said common drive motor.

8. The printing group of claim 6 further including at least one switchable coupling between at least one of said first and second printing groups and said common drive motor.

9. The printing unit of claim 1 wherein said second cylinder is a transfer cylinder and further including a forme cylinder assigned to each of said transfer cylinder and said second transfer cylinder.

10. The printing unit of claim 9 wherein all of said cylinders are in positive drive connection and can be driven by said drive motor from a direction of one of said forme cylinders.

11. The printing unit of claim 9 wherein all of said cylinders are in positive drive connection and can be driven by said common drive motor from a direction of one of said forme cylinders.

12. The printing unit of claim 1 further including a coupling between said drive motor and said first printing group, said stop being engaged in response to disengagement of said coupling.

13. The printing unit of claim 1 further including means for sensing a number of revolutions of said printing group and means for controlling said stop in accordance with a level of said number of revolutions.

14. The printing unit of claim 1 further including means for sensing a number of revolutions of said printing group and means for controlling said stop in accordance with a level of said number of revolutions.

15. The printing unit of claim 1 further including a coupling between said drive motor and said printing group and wherein in said third position said coupling is disengaged.

16. The printing group of claim 1 further including means for blocking an operation of said at least first cylinder above a predetermined maximum number of revolutions in said third position.

17. The printing unit of claim 1 wherein said at least first cylinder further includes means to block movement from said second position to said first position.

18. The printing unit of claim 17 further including a coupling between said drive motor and said printing group and further wherein said movement from said second position to said first position can be blocked by said coupling.

19. The printing unit of claim 17 further including means for sensing a difference between a number of revolutions of said printing group and a running speed of said web and for blocking said movement from said second position to said first position in response to said difference.

20. The printing unit of claim 1 further including a signal emitter adapted to determine said third position.

21. The printing group of claim 1 further including eccentric bearings supporting at least one of said cylinders and means for pivoting said eccentric bearings about a pivot axis to bring at least one of said cylinders selectively into one of said first, second and third positions.

22. The printing unit of claim 21 further including a motor adapted to actuate said eccentric bearings.

23. The printing unit of claim 21 further including a cylinder adapted to be charged with a medium under pressure for actuating said eccentric bushings.

24. The printing unit of claim 1 further including a cylinder chargeable with a pressure medium and adapted to actuate said stop.

25. A printing unit comprising:

at least a first printing group including at least first and second cylinders, said first and second cylinders forming a printing gap;

a common drive motor for driving said first and second cylinders which are in positive driving connection with each other;

means for moving said first and second cylinders relative to each other among first, second and third positions;

wherein said first position in which said first and second cylinders are in contact with each other;

wherein said second position in which said first and second cylinders are out of contact with each other;

wherein said third position in which said first and second cylinders are further removed from each other from the second position;

a separating path of an increasing distance between said first, second and third positions, movement of at least one of said first and second cylinders of said at least first printing group being limited to said second position as a function of an operating situation of a drive mechanism for said at least first printing group; and means for selectively blocking movement of said first and second cylinders into said third position.

26. The printing unit of claim 25 wherein in said third position, said at least first and second cylinders are spaced apart sufficiently to allow passage of a web between said first and second cylinders without contacting said first and second cylinders.

27. The printing unit of claim 25 further including a second printing group arranged after, in a direction of web travel, said at least first printing group.

28. The printing unit of claim 27 including a separate drive for each of said first and second printing groups.

29. The printing unit of claim 27 wherein said first and second printing groups are in positive drive connection, and further including a common drive motor for said first and second printing groups.

30. The printing unit of claim 25 wherein said positive drive connection is maintained in each of said first, second and third positions.

31. The printing unit of claim 25 wherein each of said first and second cylinders is a transfer cylinder and further including a forme cylinder assigned to each of said first and second transfer cylinders.

32. The printing unit of claim 25 further including a stop whose location can be changed, said stop being said means for selectively blocking said movement between said first, second, and third positions.

33. The printing unit of claim 32 further including a coupling between said drive motor and said first printing group, said stop being engaged in response to disengagement of said coupling.

34. The printing unit of claim 32 further including a cylinder chargeable with a pressure medium and adapted to actuate said stop.

35. The printing unit of claim 25 further including a coupling between said drive motor and said printing group and wherein in said third position said coupling is disengaged.

36. The printing group of claim 25 further including means for blocking an operation of said at least first cylinder above a predetermined maximum number of revolutions in said third position.

37. The printing unit of claim 25 wherein said at least first cylinder further includes means to block movement from said second position to said first position.

38. The printing unit of claim 32 further including a coupling between said drive motor and said printing group and further wherein said movement from said second position to said first position can be blocked by said coupling.

39. The printing unit of claim 32 further including means for sensing a difference between a number of revolutions of said printing group and a running speed of said web and for blocking said movement from said second position to said first position in response to said difference.

40. The printing unit of claim 25 further including a signal emitter adapted to determine said third position.

41. The printing group of claim 25 further including eccentric bearings supporting at least one of said cylinders and means for pivoting said eccentric bearings about a pivot axis to bring at least one of said cylinders selectively into one of said first, second and third positions.

42. The printing unit of claim 41 further including a motor adapted to actuate said eccentric bushings.

43. The printing unit of claim 41 further including a cylinder adapted to be charged with a medium under pressure for actuating said eccentric bushings.

* * * * *